United States Patent [19]

Herbst et al.

[11] Patent Number: 4,868,144

[45] Date of Patent: Sep. 19, 1989

[54] PROCESS TO REDUCE $NO_x$ EMISSIONS FROM A FLUID CATALYTIC CRACKING UNIT

[75] Inventors: Joseph A. Herbst, Turnersville; Hartley Owen, Belle Meade, both of N.J.; Paul H. Schipper, Wilmington, Del.

[73] Assignee: Mobil Oil Corporation, New York, N.Y.

[21] Appl. No.: 188,810

[22] Filed: Jun. 30, 1988

Related U.S. Application Data

[60] Continuation of Ser. No. 188,817, May 2, 1988, which is a division of Ser. No. 903,344, Sep. 3, 1986, abandoned.

[51] Int. Cl.[4] ..... B01J 38/34; B01J 29/38; C10G 11/05

[52] U.S. Cl. ..... 502/43; 208/161; 208/164; 422/144; 423/239; 502/41

[58] Field of Search ..... 502/42, 43, 41; 423/239, 239 A, 235, 235 D; 208/164

[56] References Cited

U.S. PATENT DOCUMENTS

| | | | |
|---|---|---|---|
| 2,929,774 | 3/1960 | Smith | 502/41 |
| 3,351,548 | 4/1967 | Payne et al. | 208/210 |
| 3,713,781 | 1/1973 | Dunn, Jr. | 23/284 |
| 3,821,103 | 6/1974 | Owen et al. | 502/40 |
| 3,886,060 | 5/1975 | Owen | 208/120 |
| 3,894,935 | 7/1975 | Owen | 208/78 |
| 3,926,843 | 12/1975 | Owen | 252/417 |
| 3,932,110 | 1/1976 | Payne | 208/164 |
| 4,116,814 | 9/1978 | Zahner | 208/78 |
| 4,219,407 | 8/1980 | Haddad et al. | 502/42 |
| 4,283,273 | 8/1981 | Owen | 502/42 |
| 4,313,848 | 2/1982 | Scott | 208/164 |
| 4,325,833 | 4/1982 | Scott | 208/164 |
| 4,336,160 | 6/1982 | Dean et al. | 252/447 |
| 4,388,218 | 6/1983 | Rowe | 252/417 |
| 4,404,095 | 9/1983 | Haddad et al. | 208/161 |
| 4,427,537 | 1/1984 | Dean et al. | 208/120 |
| 4,444,722 | 4/1984 | Owen | 422/144 |
| 4,448,753 | 5/1984 | Gross et al. | 422/144 |
| 4,478,708 | 10/1984 | Farnsworth | 208/164 |
| 4,482,451 | 11/1984 | Kemp | 208/161 |
| 4,502,473 | 3/1985 | Haddad et al. | 208/161 |
| 4,511,434 | 4/1985 | Vasalos | 202/99 |
| 4,584,090 | 4/1986 | Fransworth | 208/80 |
| 4,601,814 | 7/1986 | Mauleon et al. | 208/113 |

*Primary Examiner*—Paul E. Konopka
*Attorney, Agent, or Firm*—Alexander J. McKillop; Charles J. Speciale; Richard D. Stone

[57] ABSTRACT

A multistage process for reducing $NO_x$ in flue gas from fluid catalytic cracking catalyst regeneration. Flue gas is preferably removed after each stage. $NO_x$ formed in each regeneration stage is converted to $N_2$ prior to discharge from a stage by operating at least the downstream ends of each regeneration stage at oxygen-lean conditions. Staged regeneration can be achieved by passing spent catalyst through a transport reactor in plug type flow and sequentially contacting the catalyst with a plurality of oxygen-containing streams.

10 Claims, 4 Drawing Sheets

74
72
70
AIR
62
44
60
42
132
128
30
130
126
122
61
114
124
120
131
112
121
34
37
54
36
26
24
162
158
22
160
156
152
108
144
154
110
161
18
150
16
151
19
17
50
142
52
2
4
AIR

PROCESS TO REDUCE $NO_x$ EMISSIONS FROM A FLUID CATALYTIC CRACKING UNIT

CROSS-REFERENCE TO RELATED APPLICATIONS

This is a continuation of co-pending application, Ser. No. 07/188,817, filed on May 2, 1988, which is a division of a prior co-pending application Ser. No. 903,344, filed Sept. 3, 1986, now abandoned. Extensive editorial changes were made, and metric units added in the continuation.

BACKGROUND OF THE INVENTION

This invention relates to a process and apparatus for regenerating fluidized cracking catalyst.

The field of catalytic cracking, and particularly fluid catalyst operations, has undergone significant development and improvements due primarily to advances in catalyst technology and product distribution obtained therefrom. With the advent of high activity catalysts, and particularly crystalline zeolite cracking catalysts, new areas of operating technology have been encountered, requiring even further refinements in processing techniques to take advantage of the high catalyst activity, selectivity and operating sensitivity.

By way of background, the hydrocarbon conversion catalyst usually employed in a fluid catalytic cracking (FCC) installation is preferably a high activity crystalline zeolite catalyst of a fluidizable particle size. The catalyst is transferred in suspended or dispersed phase condition generally upwardly through one or more riser conversion zones (fluid catalytic cracking zones), providing a hydrocarbon residence time in each conversion zone in the range of 0.5 to about 10 seconds, and usually less than about 8 seconds. High temperature risers and 0.5 to 4 seconds hydrocarbon residence time in the riser may be used to make cracked products.

During cracking carbonaceous deposits accumulate on the catalyst. Entrained hydrocarbons are removed from the catalyst in a stripping zone. Cracked products and stripped materials are combined and typically passed to a product fractionation step. Stripped catalyst (spent catalyst) containing deactivating amounts of carbonaceous material, hereinafter referred to as coke, is then regenerated.

In catalyst regeneration, oxygen burns off coke. The hydrogen-containing components in coke form water which causes hydrothermal degradation.

U.S. Pat. No. 4,336,160 to Dean et al attempts to reduce hydrothermal degradation by staged regeneration. However, the first stage of the regeneration process of Dean et al employs a dense bed which provides an opportunity for hydrothermal deactivation.

A major trend in fluid catalytic cracking processing has been modifications to the process to permit it to accommodate a wider variety of feedstocks, in particular, stocks that contain more nitrogen than had previously been permitted in a feed to a fluid catalytic cracking unit.

Many FCC feeds contain a lot of nitrogen. There is a trend to heavier, dirtier feeds. There is also a growing concern about the amount of $NO_x$ in the regenerator flue gas. Some attempts have been made to minimize the amount of $NO_x$ discharged to the atmosphere through the flue gas by employing multiple beds in a fluid catalytic cracking regenerator.

U.S. Pat. No. 4,325,833 to Scott discloses a three-stage regenerator directed to $NO_x$ removal. Scott discloses that his middle stage contains a substantially oxygen-free atmosphere to convert $NO_x$ to $N_2$. However, flue gas from lower beds contact with catalyst from upper beds. This is detrimental because the flue gas contains water which can deactivate the catalyst by hydrothermal degradation.

It would be advantageous to provide a process which both minimizes $NO_x$ and hydrothermal degradation.

Accordingly, the present invention provides a process for fluidized bed regeneration of coke contaminated catalyst by combining a stream of coked catalyst with a stream of hot regenerated catalyst and a first oxygen-containing gas stream to form a first mixture of catalyst and gas and regenerating the catalyst by burning the coke characterized by passing the mixture through a first stage regenerator comprising a first regenerator riser having an upper end and a lower end and maintaining a low oxygen concentration in the upper end of the riser; discharging the first mixture from the riser to form a first catalyst bed located in a lower portion of a second stage regenerator; adding a second oxygen-containing stream to the first catalyst bed to form a second mixture of catalyst and gas which passes to an upper portion of the second stage regenerator and maintaining a low oxygen concentration in the upper portion of the second stage regenerator; discharging from the upper portion of the second stage regenerator catalyst with reduced coke content and flue gas; and recycling to the first stage regenerator a hot regenerated catalyst stream obtained downstream of the second stage regenerator.

The fluid catalytic cracking (FCC) process employs a catalyst in the form of fine particles which act as a fluid when aerated with a vapor. The fluidized catalyst is circulated continuously between a reactor and a regenerator and transfers heat from the regenerator to the reactor. The FCC process converts heavy hydrocarbons into more valuable gasoline and lighter products.

Figure 1:
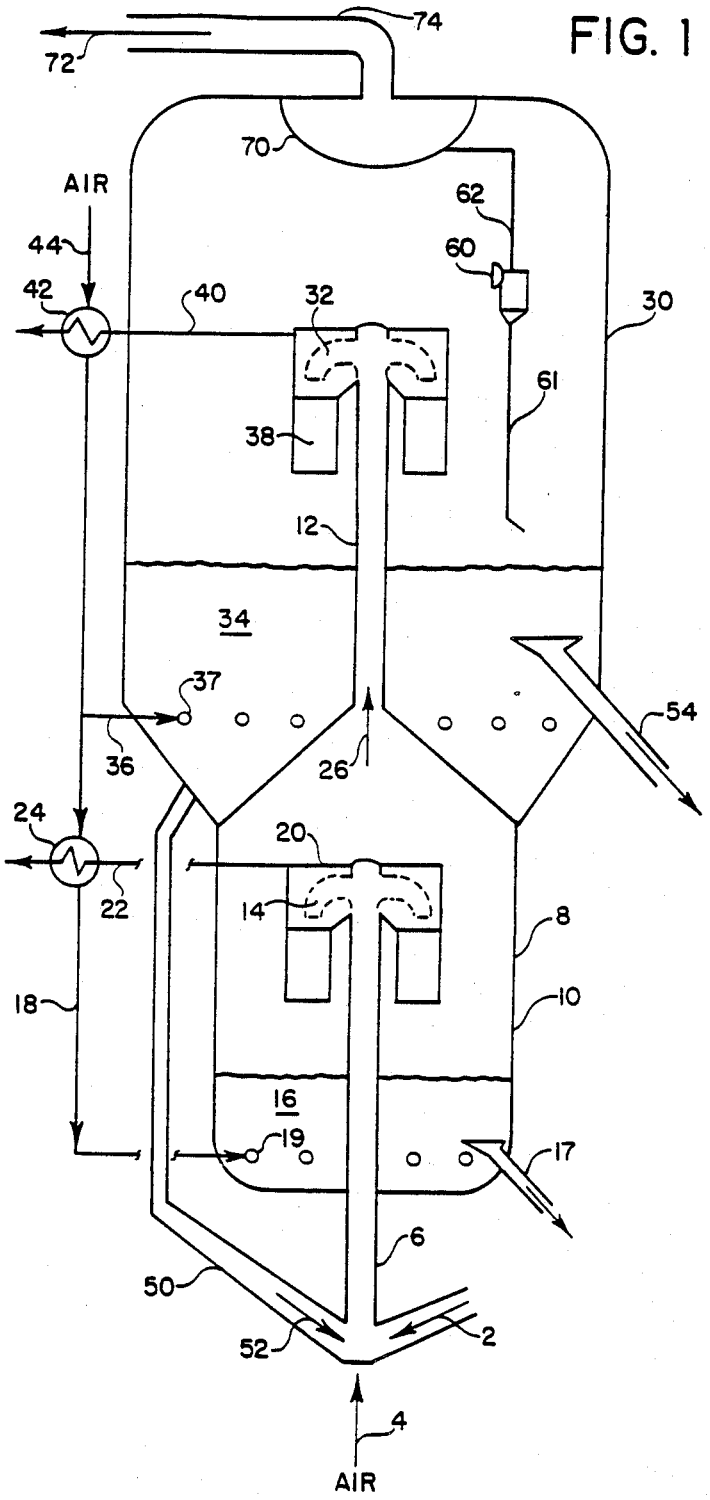
FIG. 1 is a partial cross-sectional view of a regenerator of the present invention.

FIG. 1 shows FCC regenerator 30, which regenerates spent catalyst stream 2, from an FCC reactor (not shown). The spent catalyst is conventional. Preferably it comprises intermediate pore zeolite catalyst, most preferably ZSM-5 and a large pore zeolite such as zeolite Y. The spent catalyst combines with a first airstream 4, and preferably a regenerated recycle catalyst 54 from an optional standpipe 50, to form a mixture. The mixture passes through a first regenerator riser 6. Preferably, the mixture passes through riser 6 in plug flow at 538° to 677° C. (1000° and 1250° F.). Enough air is added via line 4 to sustain combustion at the inlet and partly through the riser 6. This burns off coke and forms $H_2O$ and $NO_x$. Because the mixture through the riser 6 is basically in plug flow and oxygen is consumed, by combustion, the oxygen concentration varies along the riser 6. When the spent catalyst initially combines with airstream 4, the initial oxygen concentration is sufficiently high to promote combustion. Then as combustion continues, the oxygen concentration lessens sufficiently to shift equilibrium, denoted by the following reaction, to convert $NO_x$, produced during combustion, to $N_2$:

$$2NO_x\ N_2 + xO_2$$

The mixture is oxygen-lean, preferably having an oxygen concentration between 0 and 1 mole %, most preferably between 0 and 0.5 mole %, when it exits the riser 6. This converts a portion of the $NO_x$ to $N_2$ prior to exiting the riser 6. The mixture is discharged from the first riser 6 and passes into a plurality of discharge arms 14 which impart downward momentum to the mixture. The discharge arms 14 are housed within a riser cover 20.

After exiting the discharge arms 14, flue gas is removed as a first flue gas stream 22. The catalyst from the mixture continues down into the first catalyst bed 16, located in a lower portion 10 of a second regenerator riser 8. Riser 8 is a fast fluid bed riser. A fast fluid bed riser is disclosed in U.S. Pat. No. 4,444,722 to Owen. The lower portion 10 has a larger inside diameter than an attached upper portion 12. A second airstream 18 passes through a header 19 into the first catalyst bed 16 to promote further regeneration. Stream 18 may be preheated by indirect heat exchange with the first flue gas stream 22 in a heat exchanger 24. The amount of air passed into the first catalyst bed 16 is preferably just enough to sustain combustion in the bed 16 and partly through the second riser 8. This burns off the coke and forms $NO_x$. However, the mixture is sufficiently oxygen-lean to shift equilibrium to favor converting $NO_x$ to $N_2$. Preferably the oxygen concentration is 0 to 1 mole %, most preferably 0 to 0.5 mole % as gas exits the riser 8. This converts a portion of the $NO_x$ to $N_2$ prior to exiting the second riser 8. Bed 16 is preferably 28° C. (50° F.) or more hotter than the riser 6 exit, but not above 704° C. (1300° F.).

The airstream 18 and combustion products formed in bed 16 elutriate a first catalyst stream 26 up from first bed 16 into the upper portion 12 of the second regeneration riser 8. A second catalyst stream can be withdrawn from bed 16 through an optional conduit 17 and sent to a fluid catalytic cracking reactor (not shown).

The catalyst stream 26 passes through upper portion 12, which is located within a catalyst collecting chamber 30. Stream 26 discharges from upper portion 12 into a plurality of discharge arms 32 which impart downward momentum to the stream 26. The discharge arms 32 are housed within a riser cover 38. The downwardly directed catalyst countercurrently contacts combustion gases from a second catalyst bed 34 located therebelow. The combustion gases displace gaseous material upwardly and away from the downwardly directed catalyst. The displaced gases form a second flue gas stream 40 which exits the chamber 30 and indirectly preheats an airstream 44 in indirect heat exchanger 42. The catalyst continues downwardly to the second catalyst bed 34. A third airstream 36 passes through a header 37 into the second bed 34 to contact catalyst in bed 34. Enough air is added to bed 34 to sustain combustion with minimal hydrothermal degradation and minimal $NO_x$ formation. The $NO_x$ formation is also minimized because a substantial portion of nitrogen originally in stream 2 has been removed by the first and second stages. Bed 34 is preferably at least 14° C. (25° F.) hotter than bed 16 but below 871° C. (1600° F.).

Some hot regenerated catalyst is preferably withdrawn from bed 34 via standpipe 50 and recycled to mix with spent catalyst stream 2, as discussed above. Regenerated catalyst is withdrawn from bed 34 via conduit 54 and passed to a fluid catalytic cracking reactor (not shown). Combustion gases from second bed 34, which do not exit with second flue gas stream 40, pass up through the collecting chamber 30 to a cyclone 60, which separates gas from entrained catalyst and discharges gas via conduit 62, plenum chamber 70 and conduit 74 as a third flue gas stream 72. A number of cyclones, such as cyclone 60, in series or parallel, or both, may be provided within chamber 30. Catalyst recovered by cyclone 60 returns to second catalyst bed 34 through a dipleg 61.

This embodiment is particularly advantageous when the catalyst comprises some intermediate pore zeolites catalyst,such as ZSM-5, or particles comprising large pore zeolite catalysts, such as zeolite Y. It is desirable to subject the larger pore zeolite catalysts to more regeneration than the intermediate pore zeolite catalysts, because the larger pore zeolite catalysts tend to deactivate with coke more readily than the intermediate pore zeolite catalysts.

Figure 2:
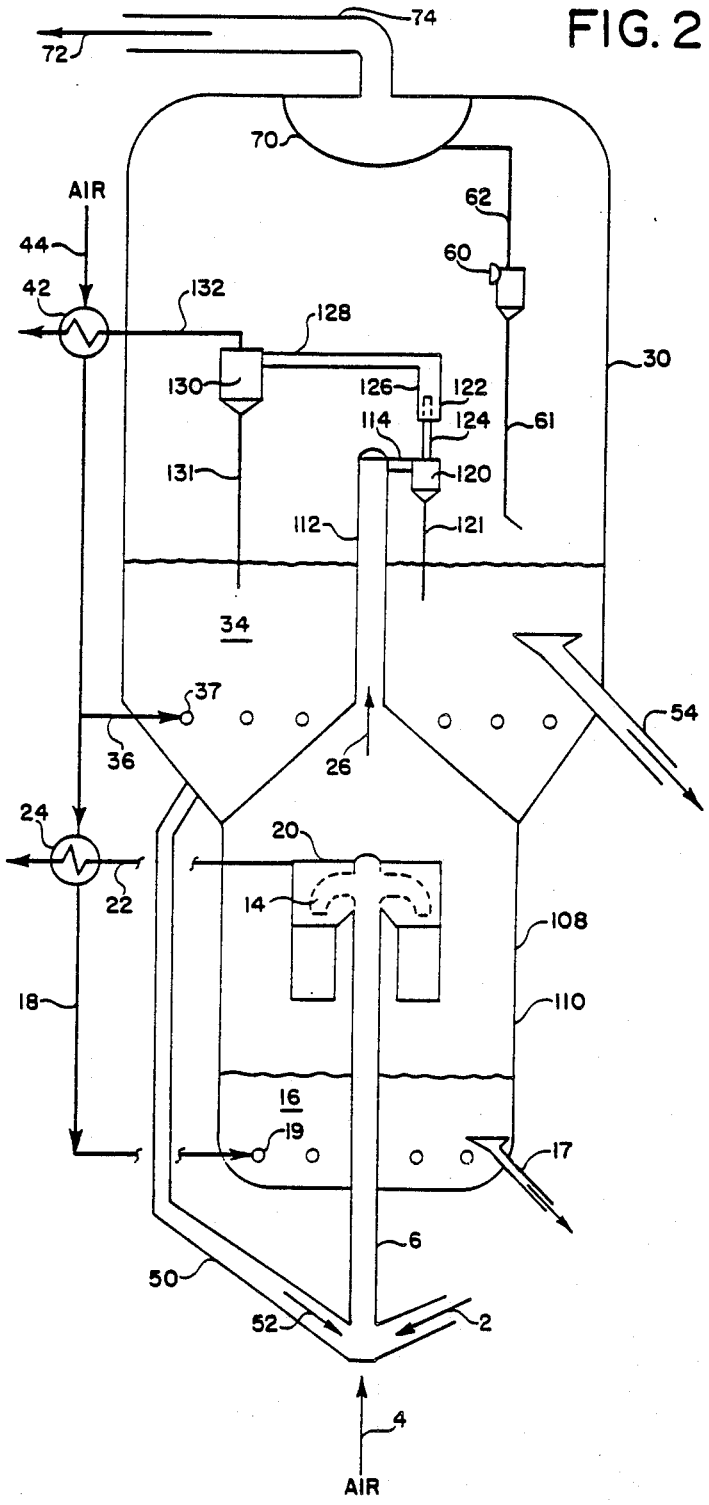
FIG. 2 is a partial cross-sectional view of a second embodiment of a regenerator of the present invention.

In a second embodiment of the present invention, shown in FIG. 2, the combination of discharge arms 32 and riser cover 38 of FIG. 1 is replaced by a series of closed cyclones. Like-numbered features in FIGS. 1 and 2 operate the same way. U.S. Pat. No. 4,404,095 to Haddad et al discloses discharge arms and a riser cover applied to a stripping section of a fluid catalytic cracking reactor vessel. U.S. Pat. No. 4,502,947 to Haddad et al shows a closed cyclone system applied to a fluid catalytic cracking reactor vessel. As shown in FIG. 2, the catalyst stream 2, airstream 4 and recycled hot regenerated catalyst 52 are combined and pass up through riser 6 into a second stage regenerator 108 having a lower portion 110 attached to an upper portion 112. A flue gas stream 22 is separated from the catalyst discharged from the riser 6 and the remaining catalyst from the mixture passes to a first catalyst bed 16. A dilute phase catalyst and gas stream 26 passes up from bed 16 through the upper portion 112 of the second riser 108. Optionally, a portion of catalyst may be withdrawn from bed 16 by an optional conduit 17 and recycled to a fluid catalytic cracking reactor (not shown).

The catalyst stream 26 discharges from the upper portion 112 into a riser cyclone inlet conduit 114 to a riser cyclone 120. The gas from riser cyclone 120 discharges via conduit 128 to cyclone 130 via conduit 122. Cyclone 130 may be attached to downstream cyclones (not shown) by a conventional enclosed conduit (not shown). Overhead gas from cyclone 130, or downstream cyclones in series (not shown), forms a second flue gas stream which exits vessel 30 through an overhead conduit 132.

The riser cyclone overhead conduit 122 includes a lower vertical conduit 124, attached to the cyclone 120, which is inserted into an upper vertical conduit 126. Conduit 126 is attached to cyclone inlet conduit 128. The annulus between conduit 124 and conduit 126 admits gas from catalyst bed 34. Preferably, the annulus is sized such that the gas velocity in it is between 1.5 and 30 m/s (5 and 100 feet per second). Catalyst recovered by cyclones 120 and 130 passes through diplegs 121, 131 to the second catalyst bed 34. Combustion gases from bed 34 which do not exit as part of the second flue gas stream pass into one or more cyclones 60 and exit through overhead conduit 62 to plenum chamber 70 and through the withdrawal conduit 74 as a third flue gas stream 72. Catalyst separated in cyclone 60 returns to the second catalyst bed 34 through a dipleg 61.

Similar to the first embodiment, the risers 6, 108 operate at oxygen-lean conditions. The first and second airstreams 4, 18 preferably supply enough air so that the mixtures exiting the first riser 6 and fast fluid bed riser 108 comprise gas having an oxygen concentration between 0 and 1 mole %, most preferably between 0 and 0.5 mole %. Exiting the first riser 6 is defined as when the mixture passes into discharge arms 14. Exiting the fast fluid bed riser is defined as when the mixture passes out of riser upper portion 112 into conduit 114. Airstream 36 preferably provides the minimum amount of air necessary to sustain combustion in bed 34.

These oxygen-lean conditions promote conversion of $NO_x$, produced during coke combustion, to $N_2$.

Figure 3:
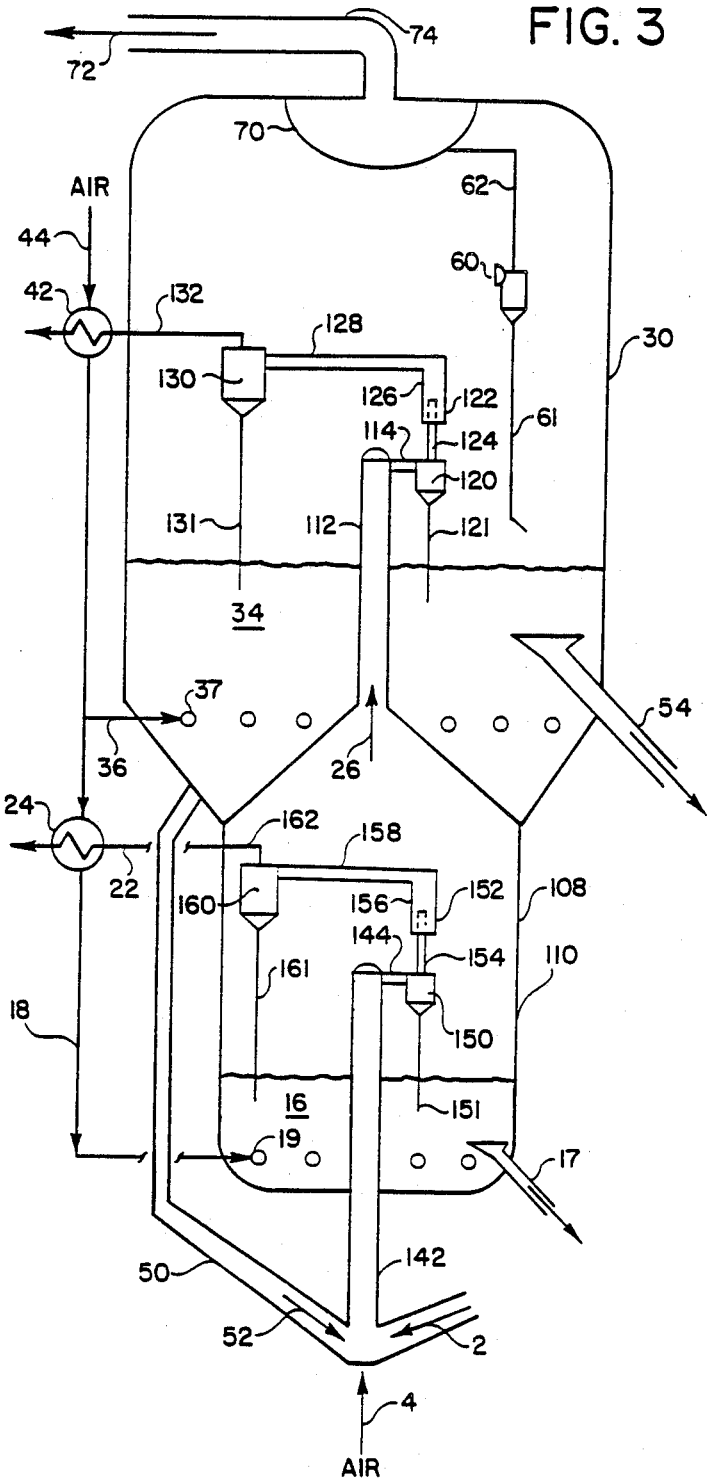
FIG. 3 is a partial cross-sectional view of a third embodiment of a regenerator the present invention.

In a third embodiment of the present invention, shown in FIG. 3, the combination of discharge arms 14 and riser cover 20 of FIG. 2 is replaced by a series of closed cyclones. In FIGS. 2 and 3, like-numbered features operate in the same way. As shown in FIG. 3, the catalyst stream 2, airstream 4 and first portion of regenerated catalyst 52 are combined and pass upwardly through a first regenerator riser 142 into a second regenerator riser 108 having a lower portion 110 attached to an upper portion 112. A closed cyclone system separates a flue gas stream 22 from the catalyst discharged from the riser 142, as discussed below. The remaining catalyst from the mixture passes to a first catalyst bed 16. A catalyst stream 26 passes upwardly from bed 16 through the upper portion 112 of the second riser 108. Optionally, a portion of catalyst may be withdrawn from bed 16 by an optional conduit 17 and recycled to a fluid catalytic cracking reactor (not shown).

The closed cyclone system separates the flue gas stream 22 from the catalyst discharged from the riser 142 as follows. The catalyst stream discharges from the riser 142 into a riser cyclone inlet conduit 144 to a riser cyclone 150. The riser cyclone 150 is connected to a primary cyclone 160 by means of a riser cyclone overhead conduit 152. The primary cyclone 160 may be attached to a secondary cyclone (not shown) by a conventional enclosed conduit (not shown). Overhead gas from the primary cyclone 160, or secondary cyclones in series (not shown), forms the first flue gas stream 22 which exits the second riser 108 through an overhead conduit 162.

The riser cyclone overhead conduit 152 includes a lower vertical conduit 154, attached to the cyclone 150, which is inserted into an upper vertical conduit 156. Conduit 156 is in turn attached to a primary cyclone inlet conduit 158. An annulus is formed between conduit 154 and conduit 156 so that a portion of gas from catalyst bed 16 may pass into upper conduit 156. Preferably, the annulus is sized such that the velocity of the gas into the annulus is between 1.5 and 30 m/s (5 and 100 feet per second). Catalyst separated in cyclones 150 and 160 passes through diplegs 151, 161 to the first catalyst bed 16.

Similar to the second embodiment, the risers 142, 108 operate at oxygen-lean conditions. The first and second airstreams 4, 18 preferably supply enough air so that the mixtures exiting the first riser 142 and fast fluid bed riser 108 comprise gas having an oxygen concentration between 0 and 1 mole %, most preferably between 0 and 0.5 mole %. The first riser 142 exit is the cyclone inlet conduit 144. The bed 108 exit is at the entrance to conduit 114. Airstream 36 preferably provides the minimum amount of air necessary to sustain combustion in bed 34.

Figure 4:
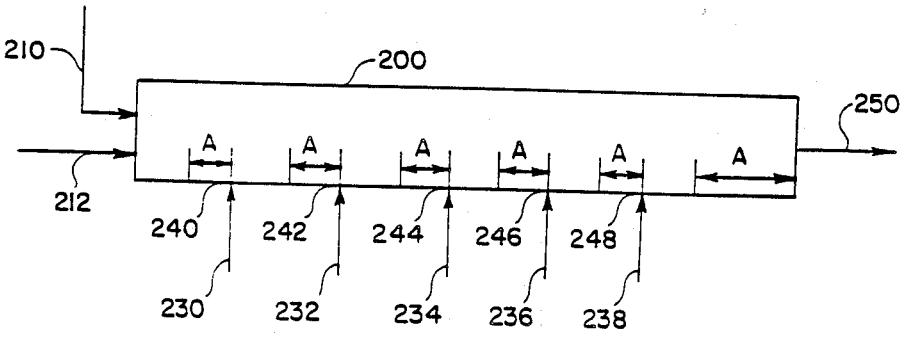
FIG. 4 is a schematic of a fourth embodiment of the invention.

FIG. 4 discloses a fourth embodiment of the present invention. The fourth embodiment is a transport-type regenerator reactor comprising a transport conduit 200 provided with a plurality of oxygen-containing airstreams 230, 232, 234, 236 and 238 sequentially provided along a portion of the conduit 200 at respective injection points 240, 242, 244, 246, 248. Each injection point 240, 242, 244, 246, 248 represents one or more injection nozzles about the perimeter of the conduit 200. The conduit 200 may be horizontal or vertical.

A spent catalyst stream 210, from a fluid catalytic cracking reactor (not shown), and an oxygen-containing airstream 212 pass into the conduit 200 and form a mixture. The mixture passes through the conduit 200 and sequentially contacts the plurality of oxygen-containing airstreams 230, 232, 234, 236, 238 at regenerating conditions.

The regenerating conditions in the conduit 200 include a gas residence time between 1 and 60 seconds, preferably between 1 and 25 seconds, and a mixture temperature between 538° and 871° C. (1000° and 1600° F.). The gas residence time between contacting the mixture with each airstream 230, 232, 234, 236, 238 is preferably at least 0.5 seconds. Said mixture passes through said transport conduit 200 in basically plug flow. Each portion of conduit 200 between the sequential injection points 240, 242, 244, 246, 248 acts as another regeneration stage.

The oxygen concentration varies along conduit 200. When the catalyst initially contacts the airstreams 212, 230, 232, 234, 236, 238, the initial oxygen concentration is sufficiently high to promote combustion. Then, as combustion continues, the oxygen is depleted so that the mixture passes through a region A of relatively lower oxygen concentration. The oxygen concentration in the region A is sufficiently low to shift equilibrium, denoted by the following reaction to convert $NO_x$, produced during regeneration, to $N_2$:

$$NO_x\ N_2 + xO$$

A regenerated mixture 250 then exits the conduit 200 and passes to a cyclone, or other gas-solid separation device (not shown), to separate into a flue gas stream and a regenerated catalyst stream. The regenerated catalyst may then undergo further regeneration or pass to a fluid catalytic cracking reactor (not shown) for combination with fluid catalytic cracking hydrocarbon feed. Further regeneration may occur by recycling, the separated catalyst to conduit 200, or in subsequent regenerator stages. For example, the conduit 200 may substitute for riser 6 of FIGS. 1 and 2, or riser 142 of FIG. 3.

The first, second and third embodiments of the present invention have the advantage that regenerating fluid catalytic cracking catalyst in stages, and quickly removing flue gas from the catalyst in each stage, minimizes hydrothermal degradation and minimizes $NO_x$ formation.

The fourth embodiment of the present invention provides multistage regeneration, to reduce $NO_x$, in a single transport conduit. This is particularly useful in retrofitting FCC regenerators.

We claim:

1. A process for fluidized bed regeneration of coke contaminated catalyst by combining a stream of coked catalyst with a stream of hot regenerated catalyst and a first oxygen-containing gas stream to form a first mixture of catalyst and gas and regenerating the catalyst by burning the coke characterized by passing the mixture through a first stage regenerator comprising a first regenerator riser having an upper end and a lower end and maintaining a low oxygen concentration in the upper end of the riser to form a catalyst and flue gas stream;

simultaneously discharging the catalyst and flue gas stream from the upper end of said riser and separating said catalyst and flue gas stream into a catalyst rich stream which is discharged down to form a first catalyst bed located in a lower portion of a second stage regenerator and a first flue gas stream which is removed as a first flue gas stream from said regenerator;

adding a second oxygen-containing stream to the first catalyst had to form a second mixture of catalyst and gas which passes to an upper portion of the second stage regenerator and maintaining a low oxygen concentration in the upper portion of the second stage regenerator; and discharging from the upper portion of the second stage regenerator catalyst with reduced coke content and flue gas and separating catalyst with reduced coke content from the flue gas and forming a second dense bed of catalyst and a second flue gas stream; and recycling to the first stage regenerator a catalyst stream obtained from said second dense bed.

2. The process of claim 1 further characterized by:

adding a third oxygen-containing gas stream to catalyst in the second catalyst bed to complete catalyst regeneration.

3. The process of claim 1, further characterized in that flow through the first riser is plug flow, and gas discharged from the riser has less than 1 mole % molecular oxygen.

4. The process of claim 1 further characterized by plug flow of the second mixture through the upper portion of the second stage regenerator, a gas residence time of 1 to 20 seconds in the second stage regenerator, and in that gas discharged therefrom has less than 1 mole % molecular oxygen.

5. The process of claim 1 further characterized in that the first riser regenerator temperature is 538° to 677° C. (1000° to 1250° F.), the first bed is at least 28° C. hotter, but does not exceed 704° C. (1300° F.), and the second bed is at least 14° C. hotter than the first bed but does not exceed 871° C. (1600° F.) and flue gas discharged from each stage of the regenerator has less than 1.0 mole % oxygen.

6. The process of claim 1 further characterized in that the flue gas discharged from each stage of the regenerator has less than 0.5 mole % oxygen.

7. The process of claim 1 further characterized in that the mixture discharged from at least one stage of the regenerator is downwardly directed by contact with a first plurality of arms extending radially from the discharge end and the arms are in a cover.

8. The process of claim 1 further characterized in that the mixture discharged from at least one stage of the regenerator is discharged directly into a cyclone which separates flue gas from catalyst.

9. The process of claim 1 further characterized by heating at least one of the oxygen-containing streams by indirect heat exchange with at least one flue gas stream.

10. The process of claim 2 further characterized by simultaneously discharging and separating the second mixture of catalyst and gas which is discharged from the upper portion of the second stage regenerator to form a catalyst stream which is discharged down to form the second dense bed and a second flue gas stream which is removed from said regenerator as a second flue gas stream and addition of the third oxygen-containing gas stream to catalyst in the second bed to complete catalyst regeneration creates a third flue gas stream which is withdrawn from above the second dense bed and removed from the regenerator as a third flue gas stream.

* * * * *